US005347966A

United States Patent [19]

Mahon et al.

[11] Patent Number: 5,347,966

[45] Date of Patent: Sep. 20, 1994

[54] SPEED-DEPENDENT AIR INTAKE SYSTEM AND METHOD FOR INTERNAL COMBUSTION ENGINES

[75] Inventors: Jeff A. Mahon, Columbus; Ross C. Berryhill, Nashville, both of Ind.

[73] Assignee: Cummins Engine Company, Inc., Columbus, Ind.

[21] Appl. No.: 81,944

[22] Filed: Jun. 25, 1993

[51] Int. Cl.[5] ..... F02N 17/02

[52] U.S. Cl. ..... 123/179.21; 123/556

[58] Field of Search ..... 123/179.21, 179.6, 145 A, 123/556, 552, 549

[56] References Cited

U.S. PATENT DOCUMENTS

| | | | |
|---|---|---|---|
| 4,357,525 | 11/1982 | Jenne | 123/179.21 |
| 4,461,249 | 7/1984 | Majkrzak | 123/179.21 |
| 4,594,975 | 6/1986 | Shigenobu | 123/179.21 |
| 4,681,070 | 7/1987 | Kurihara et al. | 123/179.21 |
| 4,682,576 | 7/1987 | Nakamura et al. . | |
| 4,723,527 | 2/1988 | Panten et al. | 123/571 |
| 4,944,260 | 7/1990 | Shea et al. | 123/556 |
| 5,094,198 | 3/1992 | Trotta et al. | 123/179.21 |
| 5,138,987 | 8/1992 | Schmid et al. | 123/179.21 |

FOREIGN PATENT DOCUMENTS

| | | |
|---|---|---|
| 4032758 | 4/1992 | Fed. Rep. of Germany . |
| 58-110854 | 7/1983 | Japan . |
| 60-60255 | 4/1985 | Japan . |
| 62-184347 | 8/1987 | Japan . |

*Primary Examiner*—Tony M. Argenbright
*Assistant Examiner*—M. Macy
*Attorney, Agent, or Firm*—Sixbey, Friedman, Leedom & Ferguson

[57] ABSTRACT

An air intake heating system and method for use in a diesel engine having a battery and alternator is provided for minimizing white smoke emissions without excessively depleting the engine battery at low engine speeds wherein the battery and not the alternator is the principal contributor of power to the air intake heater. The system generally comprises an electrically powered heater assembly for heating the intake air of the engine, a power regulation circuit electrically connected between the battery and the alternator of the engine and the heater assembly, a rotational speed sensor and a temperature sensor, and a CPU connected to the output of the speed and temperature sensors and the power regulation circuit for admitting a first, relatively low level of power to the heater assembly at low engine speeds where the battery is the primary source of power for the assembly, and a second, higher level of power when the engine speed is high enough so that the alternator becomes the principal contributor of power to the heater assembly.

25 Claims, 3 Drawing Sheets

SPEED-DEPENDENT AIR INTAKE SYSTEM AND METHOD FOR INTERNAL COMBUSTION ENGINES

BACKGROUND OF THE INVENTION

This invention generally relates to air intake heating systems for internal combustion engines, and is specifically concerned with a speed dependent air intake heater for use with a diesel engine that maximizes the reduction of white smoke emissions while minimizing the depletion of the battery during cold start-up condition.

Air intake heating systems and methods for reducing white smoke emissions of diesel engines during cold start-up conditions are known in the prior art. The purpose of these systems is to reduce the generation of white smoke when a diesel engine runs under no load or light load conditions at low temperature. Such white smoke is the result of unburned hydrocarbons in the engine exhaust and is attributable to the incomplete combustion of the diesel fuel in some or all of the engine cylinders due to misfiring. While white smoke is not a regulated exhaust emission, it is a respiratory and optical irritant and can have an adverse effect on driver visibility.

One of the most recent advances in white smoke reducing systems is disclosed in Trotta et al U.S. Pat. No. 5,094,198, assigned to the Cummins Electronic Company. In this system a microprocessor has an input that receives a signal from an intake manifold air temperature monitoring sensor, and an engine speed monitoring sensor, and an output that controls the actuation of electrically powered air heating elements that are actuated and deactuated to heat the intake air. The pattern of actuation and deactuation of the electrical air heating elements is dependent upon various combinations of sensed engine operation, sensed intake manifold air temperature and sensed battery condition. Depending upon whether the speed sensor indicates that the engine is in a cranking state, a running state, or a warmed state, the microprocessor of this system will admit different amounts of power to the heating elements.

While the air intake heating device disclosed in the '198 patent functions well in small, direct injection diesel engines used in marine applications, the applicants have observed some areas where such a device might be improved when applied to later-generation diesel engines of the type used to drive tractor trailers and other heavy equipment. Specifically, while the applicants observed that the system disclosed in the '198 patent was capable of substantially reducing white smoke emissions in such engines under cold weather conditions, it did so by making large demands on battery output. Since the battery used in such engines generally cannot be recharged by the engine alternator when cold, such a large power demand can deplete the battery charge to such an extent that the life of the battery is significantly shortened.

Clearly, what is needed is an improved air intake system and method that is capable of reducing white smoke emissions of a diesel engine to acceptable levels throughout the entire operating range of the engine without significantly shortening the life of the engine battery. Ideally, such a system should be relatively simple in structure, and inexpensive to manufacture and to install in a variety of diesel engines. It would also be desirable if such a system and method could be easily retrofitted in engines that already have some sort of microprocessor-based controller for heating the intake air of the system.

SUMMARY OF THE INVENTION

Generally speaking the invention is an air intake heating system and method for use with an internal combustion engine that fulfills all of the aforementioned criteria by admitting power to the heater circuit on the basis of whether or not the engine speed indicates that the alternator is the primary contributor of power to the heater circuit, rather than the battery. The heating system of the invention comprises an electrically powered heater assembly, which may include a pair of heater grids, for heating air that flows into the air intake of the engine in order to reduce white smoke emissions therefrom; a power regulation circuit which may take the form of a pair of relays electrically connected between the battery and the alternator of the engine and each of the heater grids of the heater assembly; a speed sensor for sensing the rotational speed of the engine, and a control circuit that is electrically connected to both the output of the engine speed sensor and the power regulation circuit for admitting different levels of power to the heater grids depending upon whether the engine speed sensed indicates that the battery or the alternator is to be the primary contributor of electrical power to the heater assembly.

The control circuit may be a central processing unit (CPU) which admits a first level of power to the heater assembly when the sensed engine speed is at a level that causes the battery to be the primary contributor of electrical power to the assembly, and a second level of power that is higher than the first when the sensed engine speed is at a level that causes the alternator to be the primary power contributor to the heater assembly. When the internal combustion engine is a relatively heavy diesel engine capable of driving a tractor trailer, the CPU may be programmed to admit the first, lower level of power to the heater assembly when the sensed engine speed is below a range of about 1,000 to 1,200 rpms and to admit the second higher level power of to the heater assembly when the sensed rotational speed of the engine is above this range. In the preferred embodiment, the CPU admits the higher level of power when the sensed engine speed is 1120 rpms, but does not revert to admitting the lower level of power until the sensed engine speed falls to 1024 rpms. Such hysteresis in the operation of the system avoids unwanted, rapid switching between the first and second power levels when the engine speed measurement is oscillating around 1120 rpms.

The first power level may be on the order of 3 amp hours, and the second power level may be approximately 6 amp hours. Such programming avoids excessive battery depletion at low engine speeds where the output of the alternator is insufficient to be the primary source of power for the heater assembly, while providing a relatively high level of heater power at the higher rotational speeds where white smoke generation is at its highest.

The system may further include a temperature sensor that senses the temperature of the air flowing through the air intake. The output of the temperature sensor is electrically connected to the CPU which is preferably programmed to provide the first and second power levels to the heater assembly in the aforementioned, speed dependent fashion only if the sensed temperature of the intake air is between 0° and 59° F. At temperature higher than 59° F., the applicants have observed that the heating of the intake air of the engine is unnecessary as white smoke emissions are minimal. At temperatures of 0° F. or less, the applicants have observed that the engine cannot be throttled in a cold at a state speed that is sufficiently high for the alternator to become the primary contributor of electrical power to the heater assembly without causing damage to the bearings. Accordingly, it is not necessary for the CPU to make any decisions on the power level conducted to the heater assembly on the basis of engine speed at temperatures less than 0° F.

The invention further encompasses a method for heating the intake air of an internal combustion engine by means of a heater assembly powered by a battery and an alternator that comprises the steps of sensing the rotational speed of the engine, and then conducting either a first or a second level of electrical power to the heater assembly, depending upon whether or not the sensed rotational speed of the engine indicates that the primary contributor of power to the heater assembly is the battery or the alternator.

The invention may be easily installed in any one of a variety of internal combustion engines where the control of white smoke emissions is desired. In prior art air intake heater systems that already comprise a temperature sensor, a speed sensor, a CPU and a power regulation circuit, the invention may be advantageously installed simply by reprogramming the CPU so that it implements the method of the invention.

BRIEF DESCRIPTION OF THE SEVERAL FIGURES

FIG. 1 is a schematic diagram of the air intake heating system of the invention, and FIGS. 2A, 2B, and 2C constitute a flow chart illustrating both the operation of the system shown in FIG. 1, and the method of the invention.

DETAILED DESCRIPTION OF THE PREFERRED EMBODIMENT

Figure 1:
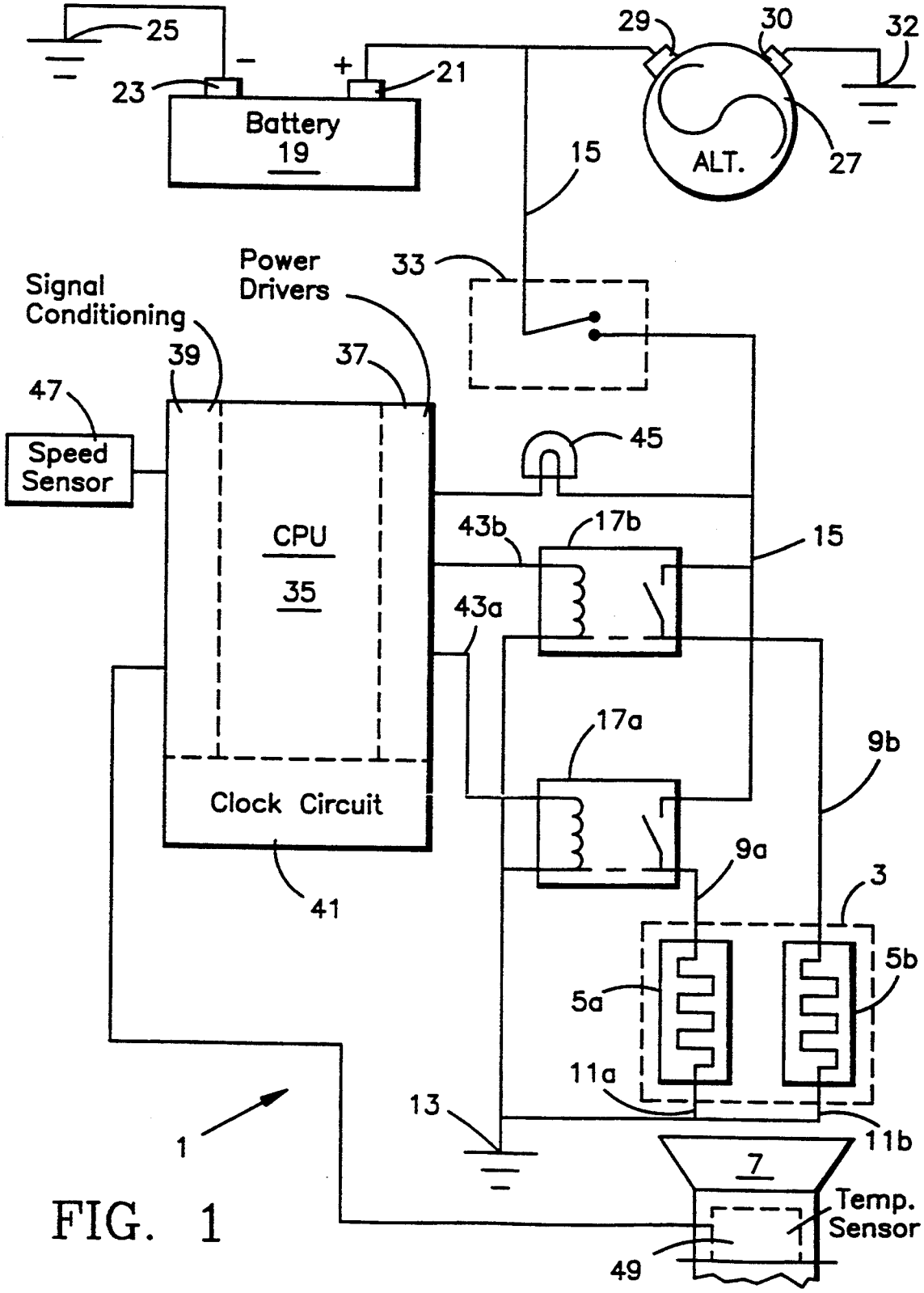

With reference now to FIG. 1, the air intake heating system 1 of the invention includes a heater assembly 3 having two individually operable heater grids 5*a,b* as shown. When the system 1 is used in combination with a 160–230 bhp diesel engine, each of the grids 5*a,b* preferably has a 95 amp power output. An example of such a diesel engine is a 1994 B series engine manufactured by the Cummins Engine Company located in Columbus, Ind. An example of such a heater grid is a 95 amp Model No. P/N 392 4594 grid heater manufactured by Phillips Temro located in Eden Prairie, Minn. The heater grids 5*a,b* are mounted in front of the air intake manifold 7 of the engine. Each of the grids 5*a,b* of the heater assembly 3 is connected to a power inlet cable 9*a,b* on one end, and a power outlet cable 11*a,b* on its other end. The power outlet cables 11*a,b* are in turn connected to ground a 13, which may be the metal frame of the truck or other vehicle where the engine is mounted. Each of the power inlet cables 9*a,b* of the grids 5*a,b* are ultimately connectable to the power cable 15 of the system 1 via relays 17*a,b*.

The power cable 15 is connected to the outputs of both the battery 19 and alternator 27 of the engine. The battery 19 is a 12 volt DC power source having a positive terminal 21 connected to the power cable 15, and a negative terminal 23 connected to a ground 25. The alternator 27 is a 12 volt, AC power source having an output terminal 29 connected to both the positive terminal 21 of the battery 19, as well as the power cable 15, and another terminal 30 connected to a ground 32 as shown. As was the case with the ground 13, grounds 25 and 32 may be the metallic body of the truck or other vehicle where the engine is employed. A key-operated ignition switch 33 selectively connects the combined output of the battery 19 and alternator 29 to the power cable 15 as shown. It should be noted that the ignition switch 33 has three separate operating positions including an "off" position, a "run" position which may permit the heater assembly 3 to obtain power from the battery 19 when the key is first turned, and a "crank" position which actuates an electrically-operated starting motor (not shown) to turn and start the engine.

The air intake system 1 further includes a CPU 35 having an output 37 which includes power driving circuits, and input 39 which includes signal conditioning circuits, and a clock circuit 41. The output circuits 37 of the CPU 35 are connected to driver leads 43*a,b* of each of the relays 17*a,b*, respectively. In the preferred embodiment, the CPU 35 is the same CPU used in the automatic transmission of a truck, such as a Model No. 3619602 CPU sold by the Cummins Engine Company located in Columbus, Ind. An indicator lamp 45 is further connected between the output circuits 37 of the CPU 35, and the power cable 15. The function and purpose of the lamp 45 will become more evident when the method of the invention is described hereinafter.

Connected to the input circuits 39 of the CPU 35 are an engine speed sensor 47 that measures the rotational speed of the engine crank shaft (not shown) in rpms, as well a temperature sensor 49 placed in thermal contact with the air entering the intake manifold 7 of the engine. In the preferred embodiment, the engine speed sensor 47 is a Model No. A/N 3920360 tachometer sensor manufactured by American Electronic Components located. The output of such a sensor can advantageously serve the dual function of driving a dash-mounted tachometer. The temperature sensor 49 is preferably a Model No. P/N 3918461 sold by the Cummins Engine Company located in Columbus, Ind. While any one of a number of alternative, commercially available temperature sensors may be used, any such sensor must be capable of generating an electric signal indicative of a range of temperature between 40° F. and 60° F., for reasons which will become evident hereinafter.

Figure 2A:
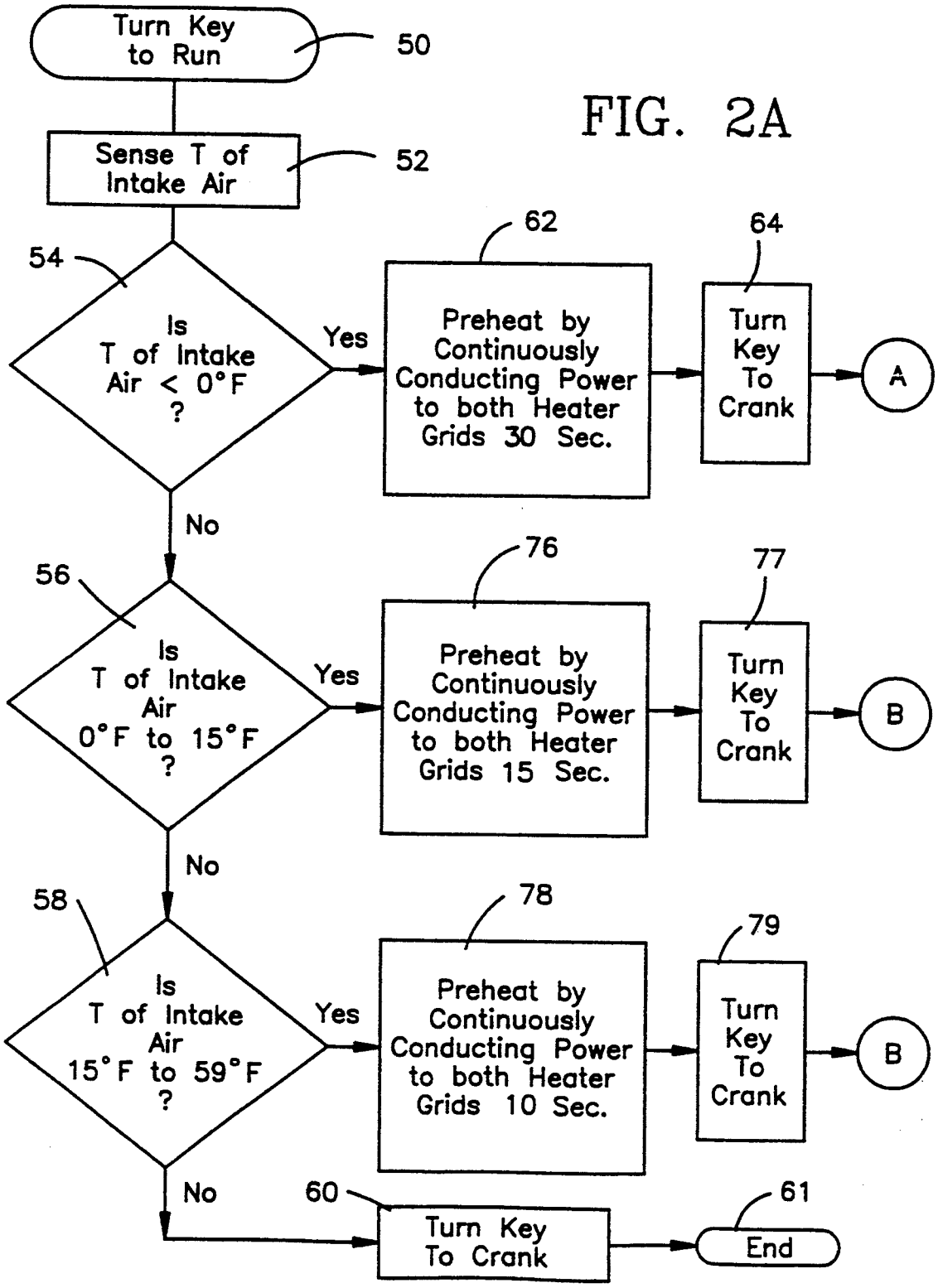

With reference now to FIG. 2A, the first step in the operation of the system 1 (and in the method of the invention) is turning the ignition switch 33 to the "run" position as indicated in block 50. Next, the temperature sensor 49 senses the temperature of the intake air, as is indicated in block 52. Upon receiving an electrical signal from the temperature sensor 49 that indicates the intake air temperature, the CPU 35 categorizes the temperature sensed into one of three categories, as indicated by question blocks 54, 56, and 58. The first question asked by the CPU 35 is whether or not the temperature of the intake air is less than 0° F., as is indicated by question block 54. If the answer to this question is "yes", then the CPU 35 proceeds to implement a 30 second preheat and the balance of the program along pathway A as will be described in detail hereinafter. If, however, the answer to the question posed in block 54 is "no", then the CPU 35 asks whether or not the temperature of the intake air is between 0° F. to 15° F., as is indicated in question block 56. If the answer to question 56 is "yes", then the CPU 35 implements a 15 second preheat and then proceeds along the balance of the program along branch B in a manner that will be described in more detail hereinafter. However, if the answer to this question is "no", then the CPU 35 inquires as to whether the temperature of the intake air is between 15 ° F. and 59° F. as is indicated in question block 58. If the answer to this question is "yes", the CPU again proceeds along branch B of the program, albeit after implementing a 10 second preheat. However, if the answer to the question posed in block 58 is "no", the CPU 35 does not actuate the heater assembly 3 of the system 1 at all, either for preheat or post heat, and merely indicates to the driver, via indicator light 55, to turn the key 33 to the crank position as is indicated in box 60. The reason that the heater assembly 3 is not actuated along this particular path of the program is that the applicants have found that it is unnecessary to heat the intake air of the engine when the ambient air temperature is such that the air entering the engine is 60° F. or higher. Under such circumstances, after the engine is cranked in accordance with block 60, the program ends as is indicated by block 61.

Returning now to question block 54, if the sensed temperature of the intake air is less than 0° F., the CPU 35 proceeds to implement preheating block 62 by closing both relays 17*a,b* in order to actuate both of the heater grids 5*a,b* of the assembly 3 for 30 seconds. At the same time, the CPU actuates the indicator "wait to start" light 45. The 95 amp capacity of each of the heater grids 5*a,b* warms the air considerably in the vicinity of the air intake during this 30 seconds. At the end of the 30 second time period, the CPU deactuates the "wait to start" indicator light 45 to inform the operator of the system to turn the ignition switch 33 and crank the engine, as is indicated in block 64. The warm air entering the engine as a result of the preheating step 62 facilitates the starting of the engine at this juncture.

Figure 2B:
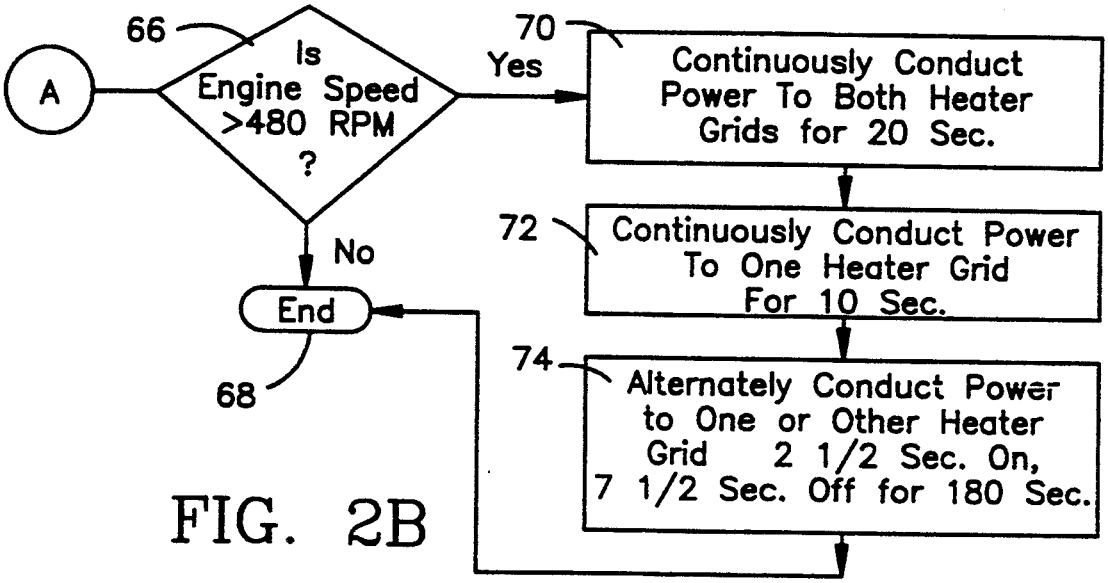

With reference now to FIG. 2B, after the key has been turned to the crank position, and released, the CPU 35 proceeds to question block 66 and inquires whether the output from the engine speed sensor 47 indicates whether the engine speed is greater than 480 rpms. If the answer to this question is "no" the CPU 35 terminates the program, as is indicated by block 68, under the assumption that the engine has failed to start. The operator then turns the ignition switch 33 back into the "off" position to reset the program, whereupon the CPU 35 repeats the implementation of blocks 56 through 66. If, however, the answer to the question posed in block 66 is "yes", then CPU 35 assumes that the engine has started, and proceeds to implement block 70 by closing the relays 17*a,b* again, and continuously conducting power to both of the heater grids 5*a,b* for a time period of 20 seconds. After 20 seconds has expired, the CPU 35 then opens one of the relays 17*a,b* and continues to conduct power to one of the heater grids 5*a,b* for a time period of 10 seconds. The purpose of the operations in blocks 70 and 72 is to quickly assist the cold engine in a smooth idle warm-up, in addition to minimizing white smoke emissions immediately after the initial cranking-up of the engine. After the 10 second duration of block 72 has elapsed, the CPU 35 then post-heats the intake air of the engine in accordance with block 74, which is conservative in the consumption of power. Specifically, the CPU 35 alternately conducts power to one or the heater grids 5*a,b* such that grid 5*a* is on for 2½ seconds and off for 7½ seconds, whereupon heater grid 5*b* is on for 2½ seconds and off for 7½ seconds, etc. This step is, of course, implemented by the alternate closing and opening of the relays 17*a,b* which admit power to the grids 5*a,b* , respectively. After the 180 second duration of block 74 has elapsed, the program ends as is indicated by block 68.

Branch A of the program implemented by the CPU 35 was designed under the realization that, under very cold starting conditions (under 0° F.), the speed of the engine cannot, as a practical matter, be raised to a level which would cause the alternator 27 to become the primary contributor of electrical power to the heater assembly 3. Under such cold weather conditions, the engine oil is very viscous upon initial start-up. Because such viscous oil cannot initially provide effective lubrication to the bearings and other moving parts of the engine, if the operator of the engine opened its throttle immediately after engine start-up to raise the engine speed to 1,120 rpms or greater (upon which the alternator 27 would become the primary power contributor to the heater assembly 3), considerable engine wear and damage could result. Accordingly, branch A of the program implemented by the CPU 35 is designed to facilitate engine start-up and to minimize white smoke emissions with no power assistance from the alternator 27, and with only a minimum amount of power expenditure from the battery 19. While the power drawn from the battery is relatively high for the operations in blocks 62 and 70, the total amount of time that these steps lasts is only 50 seconds. By contrast, for the 190 second duration of heating steps 72 and 74, the power draw on the battery 19 is relatively modest (i.e., on the order of 3 amp/hours), which allows this branch of the program to achieve the objectives of a relatively quick start and minimal white smoke emission without excessive depletion of the battery 19.

With reference again to FIG. 2A, if the answer to the questions posed in blocks 56 and 58 is "yes", the CPU 35 implements either block 76 or block 78 by closing both of the relays 17*a,b* in order to continuously conduct power to both of the heater grids 5*a,b* . The only difference between blocks 76 and 78 is that in block 76, both heater grids 5*a,b* are actuated for a time period of 15 seconds, while in block 78, they are actuated for a time period of 10 seconds. The lesser period of actuation in block 78 follows from the recognition that the intake air does not have to be heated as much when it is above 15° F. in order to facilitate the starting of the engine. After the 15 second or 10 second time period for either block 76 or 78 has elapsed, the "wait to start" indicator light 45 is deactuated by the CPU 35, thereby signalling the engine operator to close the ignition switch 33 and crank the engine, as is indicated by blocks 77 and 79 respectively.

Figure 2C:
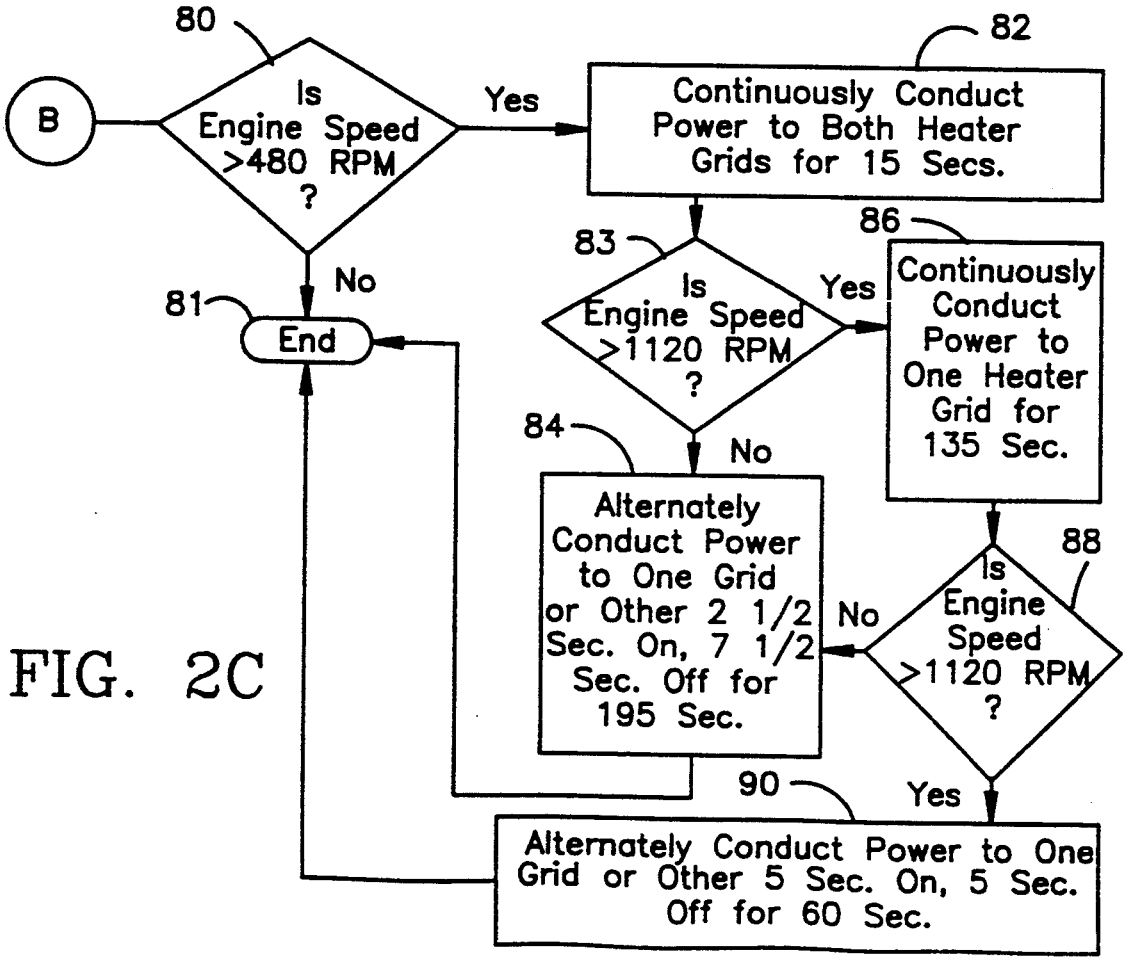

With reference now to FIG. 2C, branch B of the program is followed after either of the preheating blocks 77 or 79 is implemented. In the first step of branch B of the program, the CPU 35 inquires as to whether the engine speed is greater than 480 rpms, as is indicated in question block 80. If the answer to this question is "no", then the CPU 35 terminates the program as is indicated in block 81 under the assumption that the engine has failed to start. The operator then turns the ignition switch 33 to the "off" position and resets the program back at block 50. However, if the answer to the question posed in block 80 is "yes", then the CPU 35 proceeds to block 82, and continuously conducts power to both of the heater grids 5*a,b* for 15 seconds by closing relays 17*a,b* for this amount time. As was the case with blocks 77 and 72 previously discussed, the purpose of the step implemented in block 82 is to quickly warm up the engine, which in turn assists it in minimizing white smoke emissions. After the 15 second time period of block 82 has elapsed, the CPU 35 proceeds to block 83 and inquires whether or not the speed of the engine is greater than 1,120 rpms. If the answer to this inquiry is "no", then the logic behind the program assumes that while the engine has cranked and is started, it is not running at a speed sufficient for the alternator 27 to be primary contributor of power to the heater assembly 3. Accordingly, in order to heat the intake air to a level sufficient to substantially reduce white smoke emission but with a power consumption that would not excessively deplete the battery 19, the CPU 35 implements block 84. In this block, power is alternately conducted to one grid 5*a* or the other 5*b* in a 2½ second on, 7½ second off duty cycle in order to both conserve battery power, and to equalize the use of the grids 5*a,b*. This pattern is repeated for a time period of 195 seconds, whereupon the CPU 35 proceeds to terminate the program at block 81.

If, however, the answer to the inquiry posed in block 83 is "yes", the CPU 35 proceeds to block 86 and continuously conducts power to one or the other of the heater grids 5*a,b* for a time period of 135 seconds. While the step contained in block 86 entails substantially more power consumption than the step of block 84, the engine speed is sufficiently high enough so that the alternator 27, and not the battery 19, is the principal contributor of power to the heater circuit 3. Accordingly, step 86 can be implemented without any significant depletion of the battery 19. At the termination of the step contained in block 86 after 135 seconds, the CPU proceeds to pose the question in block 88, and inquires again if the engine speed is still greater than 1,120 rpms. If the answer to this inquiry is "no", the CPU still continues to heat the intake air with the heater grids 5*a,b*, but in the power-conserving mode of block 84. If the answer to the inquiry of question block 88 is "yes", the CPU proceeds to implement the step of block 90, wherein power is alternately conducted to one of the heater grids 5*a,b* or the other in a 5 second on/5 second off duty cycle. Specifically, the CPU closes the relay 17*a* for a period of 5 seconds to actuate 5*a* for this amount of time, and then opens 17*a* for 5 seconds while continuously maintaining relay 17*b* open. After the first 10 seconds has elapsed, relay 17*b* is closed for 5 seconds, open for 5 seconds while relay 17*a* continuously remains open. This sequence is repeated for a time period of 60 seconds, whereupon the program is ended as indicated at block 81. The rationale behind the program at block 90 is that because the engine speed is sufficiently high enough for the alternator 27 to be principal contributor of power to the heater assembly 3, and that the balance of the post heating operation can be carried out by means of a faster and more power-consuming step without any significant depletion of the battery 19.

While not specifically indicated in the flow chart, the engine speed inquires of blocks 83 and 88 are continuously made all during the execution of blocks 86 and 90. In the event that the engine speed should fall to speed of less than 1120 rpms at these times, the CPU 35 is programmed not to shift to the low power mode of heater operation (shown in block 84) until the sensed engine speed falls below 1024 rpms. Such hysteresis in the operation of the system 1 avoids unwanted, rapid switching between high and low power levels when the engine speed measurement oscillates around 1120 rpms.

We claim:

1. An air intake heating system for use with an internal combustion engine having a battery and an alternator, comprising:

an electrically powered heater assembly for heating air that flows into an air intake of said engine to reduce white smoke emissions from said engine;

a power regulation circuit electrically connected between a power output of said battery and said alternator and said heater assembly for regulating the amount of electrical power conducted to said heater assembly from said battery and alternator;

means for sensing the rotational speed of the engine and for producing an electrical signal indicative of said engine speed, and a control circuit means in communication with both the signal produced by said speed sensing means and said power regulation circuit for admitting different levels of power to the heater assembly dependent upon whether the engine speed sensed indicates that said battery or said alternator is to be the primary contributor of electrical power to the heater assembly.

2. The air intake heating system of claim 1, wherein said control circuit means admits a first level of power to the heater assembly when the sensed engine speed is at a level that causes the battery to be the primary contributor of electrical power to the heater assembly, and a second level of power that is substantially higher than said first level when the sensed engine speed is at a level that causes the alternator to be the primary contributor of electrical power to the heater assembly.

3. The air intake heating system of claim 1, further comprising means for sensing the temperature of air flowing into said air intake and for producing an electrical signal indicative of said temperature, and wherein said control circuit means is electrically connected to said temperature sensing means and functions to conduct power to said heater assembly at different levels dependent upon said sensed engine speed only when the sensed air intake temperature is between 0° F. and 59° F.

4. The air intake heating system of claim 1, wherein said heater assembly includes first and second electric heater means, and said power regulation circuit includes first and second switching circuits for regulating power to said first and second heater means, respectively.

5. The air intake system of claim 4, wherein said control circuit means includes a clock circuit for generating an electric signal indicative of the amount of time that said first and second switching circuit are closed and open.

6. The air intake system of claim 5, wherein said control circuit means opens and closes said switching circuits over time such that said second power level is about 50% larger than said first power level.

7. The air intake system of claim 5, wherein said control circuit means opens and closes said switching circuits over time such that said first power level is about 3 amp/hours and said second power level is about 6 amp/hours.

8. The air intake system of claim 5, wherein said control circuit means opens and closes said switching circuits such that each of said first and second electric heater means are operated for substantially the same amount of time.

9. The air intake system of claim 1, wherein said control circuit means admits said second level of power to said heater assembly when said speed monitoring means detects a rotational engine speed of between 1000 and 1200 rpms.

10. The air intake system of claim 1, further comprising an ignition switch means for operating an ignition system of the engine, wherein said control circuit means is electrically connected to an output of said ignition switch means, and functions to admit power to said heater assembly at said second power level for preselected periods of time both before and after said ignition system starts the operation of said engine.

11. An air intake heating system for use with an internal combustion engine having a battery and an alternator, comprising:

an electrically powered heater assembly for heating air that flows into an air intake of said engine to reduce white smoke emissions from said engine;

a power regulation circuit electrically connected between a power output of said battery and said alternator and said heater assembly for regulating the amount of electrical power conducted to said heater assembly from said battery and alternator;

means for sensing the rotational speed of the engine and for producing an electrical signal indicative of said engine speed;

means for sensing the temperature of the air flowing into the air intake and for producing an electrical signal indicative of said air temperature, and a control circuit means in communication with the signals produced by said speed and temperature sensing means and further in communication with said power regulation circuit for admitting first and second levels of power to said heater assembly dependent upon whether the engine speed sensed indicates that said battery or said alternator is to be the primary contributor of electrical power to the heater assembly, and further dependent upon whether the temperature of the intake air sensed is within a preselected range.

12. The air intake heating system of claim 11, wherein said control circuit means admits said first level of power to said heater assembly when the sensed engine speed indicates that the primary contributor of power to said assembly is to be said battery, and said second level of power to said heater assembly when the sensed engine speed indicates that the primary contributor of power is to be said alternator, wherein said second power level is at least 40% higher than said first power level.

13. The air intake heating system of claim 11, wherein said control circuit means will select said first or second power level dependent upon said sensed engine speed only if said sensed intake air temperature is between about 0° F. and 59° F.

14. The air intake heating system of claim 11, further comprising an ignition switch having a first position for actuating said heater assembly, said power regulation circuit, said speed and temperature sensing means, and said control circuit, and a second position for cranking said engine, and wherein said control circuit means will select said first or second power level dependent upon said sensed engine speed only if said switch has been used to crank said engine.

15. The air intake heating system of claim 11, wherein said heater assembly includes first and second electric heater means, and said power regulation circuit includes first and second switching circuits for regulating power to said first and second heater means, respectively.

16. The air intake system of claim 15, wherein said first and second heater means draw substantially the same amount of electrical power.

17. The air intake system of claim 16, wherein said control circuit means includes a clock circuit for generating an electric signal indicative of the amount of time that said first and second switching circuit are closed and open.

18. The air intake system of claim 17, wherein said control circuit means opens and closes said switching circuits over time such that said second power level is about 50% larger than said first power level.

19. The air intake system of claim 15, wherein said control circuit means opens and closes said switching circuit over time such that said first power level is about 3 amp/hours and said second power level is about 6 amp/hours.

20. The air intake system of claim 11, wherein said control circuit means admits said second level of power to said heater assembly when said speed monitoring means detects a rotational engine speed of between 1100 and 1150 rpms.

21. The air intake system of claim 14, wherein said control circuit means admits power to said heater assembly at said second power level for a preselected period of time when said ignition switch is turned to said first position, and another preselected period of time after said switch has been turned to said second position and has cranked said engine.

22. A method for heating the intake air of an internal combustion engine by means of a heater assembly powered by a battery and an alternator of said engine, comprising the steps of:

a) sensing the rotational speed of the engine, and b) conducting a first level of electrical power to said heater assembly if the sensed rotational speed indicates that the primary contributor of power to said heater assembly is to be said battery and conducting a second level of electrical power to said heater assembly if the sensed rotational speed indicates that the primary contributor of power to said heater assembly is to be said alternator, wherein said second power level is greater than said first power level.

23. The method for heating the intake air as described in claim 22, further comprising the steps of sensing the temperature of the air entering the air intake of said engine before step (a), and only performing step (b) if the temperature sensed is between about 0° and 59° F.

24. The method for heating the intake air as described in claim 22, further comprising the steps of (c) sensing the temperature of the air entering the air intake of said engine, (d) conducting said second level of electric power to said heater assembly for a predetermined amount of time if the temperature sensed is less than 59° F., and (e) cranking said engine, wherein steps (c), (d) and (e) are sequentially performed before step (a).

25. The method for heating the intake air as described in claim 24, further comprising the sequential steps of (f) determining whether the engine speed is greater than 480 rpms, and (g) continuously conducting electric power to said heater assembly at said second level for a predetermined period of time, wherein steps (c) through (g) are sequentially performed before step (a).

* * * * *